US011344770B2

(12) United States Patent
Sosa Baca

(10) Patent No.: US 11,344,770 B2
(45) Date of Patent: May 31, 2022

(54) LANYARD PULLEY ATTACHMENT

(71) Applicant: Angel Gustavo Sosa Baca, Morningside, MD (US)

(72) Inventor: Angel Gustavo Sosa Baca, Morningside, MD (US)

( * ) Notice: Subject to any disclaimer, the term of this patent is extended or adjusted under 35 U.S.C. 154(b) by 0 days.

(21) Appl. No.: 16/601,410

(22) Filed: Oct. 14, 2019

(65) Prior Publication Data

US 2021/0322831 A1 Oct. 21, 2021

Related U.S. Application Data

(60) Provisional application No. 62/745,424, filed on Oct. 14, 2018.

(51) Int. Cl.
*A63B 29/02* (2006.01)

(52) U.S. Cl.
CPC ..... *A63B 29/02* (2013.01)

(58) Field of Classification Search
CPC ..... A63B 29/02; A63B 2209/00
See application file for complete search history.

(56) References Cited

U.S. PATENT DOCUMENTS

| | | | | | |
|---|---|---|---|---|---|
| 4,553,633 | A * | 11/1985 | Armstrong | A62B 35/0037 | 119/857 |
| 5,975,243 | A * | 11/1999 | Lorbek | A62B 1/14 | 182/192 |
| 6,029,777 | A * | 2/2000 | Rogelja | A62B 1/14 | 182/193 |
| 6,561,313 | B2 * | 5/2003 | Hewlett | A62B 1/14 | 182/193 |
| 6,899,203 | B1 * | 5/2005 | Golden | A62B 1/14 | 182/5 |
| 9,415,245 | B2 * | 8/2016 | Codega | A62B 1/14 | |
| 2003/0034203 | A1 * | 2/2003 | Hewlett | A62B 1/14 | 182/5 |
| 2003/0196853 | A1 * | 10/2003 | LeBeau | A62B 1/14 | 182/5 |
| 2010/0181142 | A1 * | 7/2010 | Gerner | A62B 35/0081 | 182/5 |
| 2012/0111665 | A1 * | 5/2012 | Paglioli | A63B 29/02 | 182/5 |
| 2013/0180800 | A1 * | 7/2013 | Mauthner | A62B 1/14 | 182/5 |
| 2016/0228730 | A1 * | 8/2016 | Chaumontet | A63B 29/02 | |
| 2018/0008844 | A1 * | 1/2018 | Klinke | A62B 1/14 | |

* cited by examiner

*Primary Examiner* — David M Upchurch

(57) ABSTRACT

An adjustable positioning lanyard and repelling device with a hook on each side structured and arranged to have one end attach to a user's anchor and the other goes on a user's harness. The hook that attaches on the harness is an adjustable device. The device may provide a user the option to position on any solid anchor without having to hold themselves with any of their hands.

6 Claims, 5 Drawing Sheets

LANYARD PULLEY ATTACHMENT

CROSS-REFERENCE TO RELATED APPLICATION

The present application is related to and claims priority from prior provisional application Ser. No. 62/745,424, filed Oct. 14, 2018 which application is incorporated herein by reference.

BACKGROUND OF THE INVENTION

1. Field of the Invention

The present invention relates generally to the field of lanyard devices and more specifically relates to an adjustable positioning lanyard and repelling device with a hook on each side structured and arranged to have one end attach to a user's anchor and the other goes on a user's harness. The hook that attaches on the harness is an adjustable device. The device may provide a user the option to position on any solid anchor without having to hold themselves with any of their hands.

2. Description of the Related Art

Rock climbing is an activity in which participants climb up, down or across natural rock formations or artificial rock walls. The goal is to reach the summit of a formation or the endpoint of a usually pre-defined route without falling. Due to the length and extended endurance required and because accidents are more likely to happen on the descent than the ascent, rock climbers do not usually climb back down the route. Professional rock climbing competitions have the objectives of either completing the route in the quickest possible time or attaining the farthest point on an increasingly difficult route. When using a hook adjustable positioning lanyard assembly to rappel down, it can be very difficult to pull yourself up to your original position.

Various attempts have been made to solve problems found in lanyard device art. Among these are found in: U.S. Pub. No. 2005/0217937 to Bradley Rohlf; U.S. Pat. No. 4,159,044 to Walter B. Wydra; U.S. Pub. No. 2009/0178887 to Reeves et al.; U.S. Pub. No. 2011/0290586 to Russell et al; and U.S. Pat. No. 3,630,488 to Anton Stangl. This prior art is representative of adjustable safety lanyard and adjustable lifeline devices.

None of the above inventions and patents, taken either singly or in combination, is seen to describe the invention as claimed. Thus, a need exists for a reliable Lanyard Pulley Attachment, an adjustable positioning lanyard and repelling device with a hook on each side structured and arranged to have one end attach to a user's anchor and the other goes on a user's harness. The hook that attaches on the harness is an adjustable device. The device may provide a user the option to position on any solid anchor without having to hold themselves with any of their hands and to avoid the above-mentioned problems.

BRIEF SUMMARY OF THE INVENTION

In view of the foregoing disadvantages inherent in the known lanyard device art, the present invention provides a novel Lanyard Pulley Attachment. The general purpose of the present invention, which will be described subsequently in greater detail, is to provide an adjustable positioning lanyard and repelling device with a hook on each side structured and arranged to have one end attach to a user's anchor and the other goes on a user's harness. The hook that attaches on the harness is an adjustable device. The device may provide a user the option to position on any solid anchor without having to hold themselves with any of their hands. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures that accompany the written portion of this specification illustrate embodiments and method(s) of use for the present invention, Lanyard Pulley Attachment, constructed and operative according to the teachings of the present invention.

Figure 1:
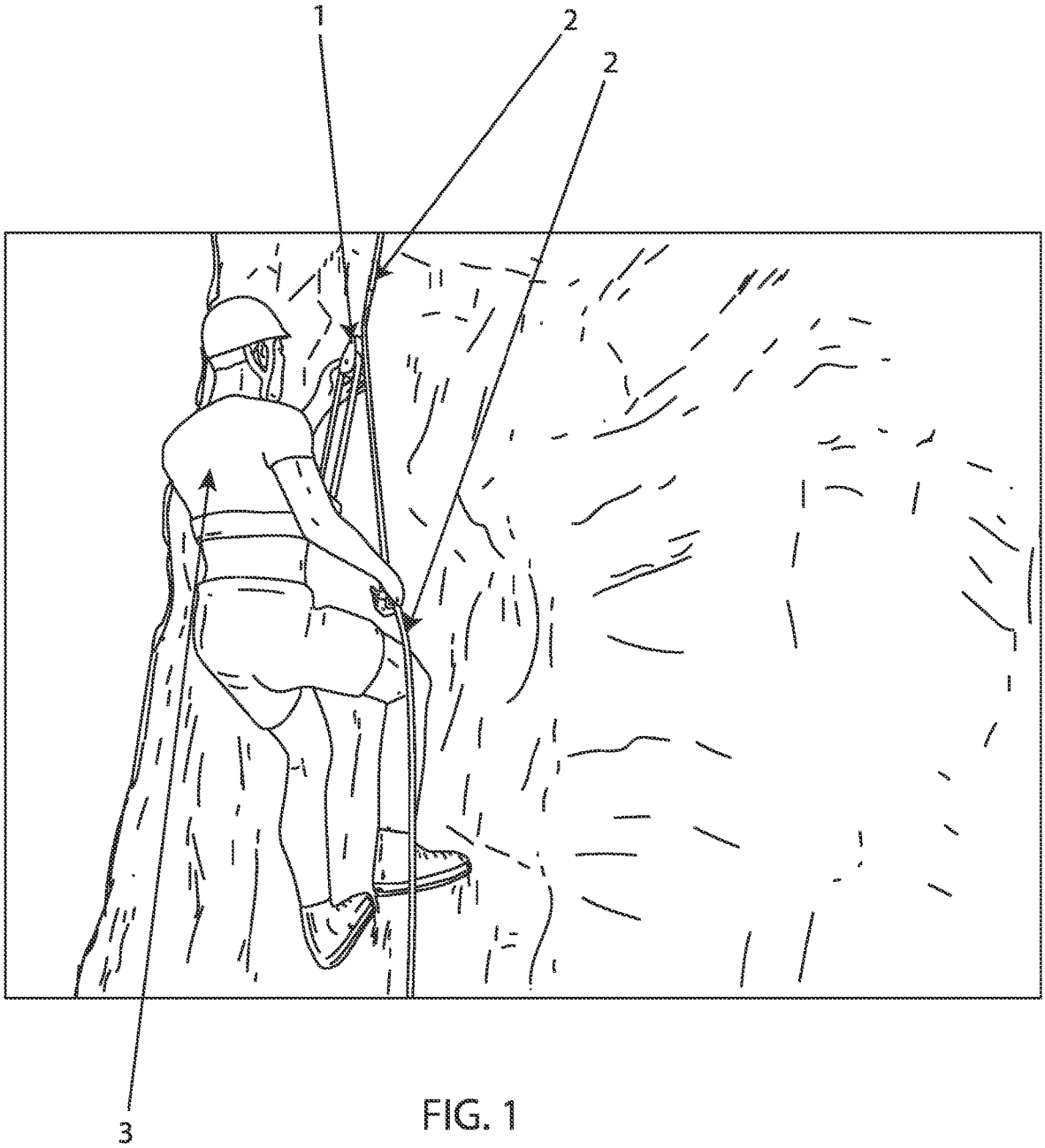
FIG. 1 shows perspective view illustrating a Lanyard Pulley Attachment as used by a user to ascend a rock face, according to an embodiment of the presently claimed invention.
Figure 5:
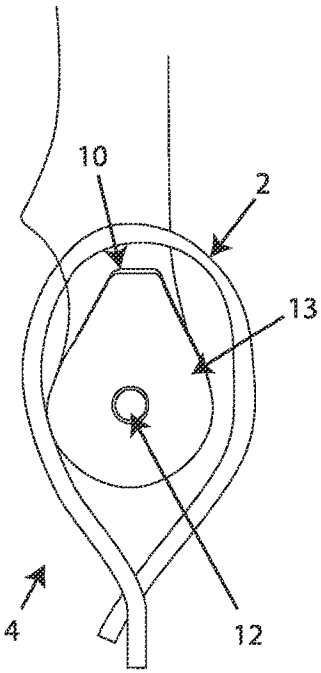
FIG. 5 shows a perspective view illustrating the pulley for Lanyard Pulley Attachment with a looped rope over it, according to an embodiment of the presently claimed invention.
Figure 4:
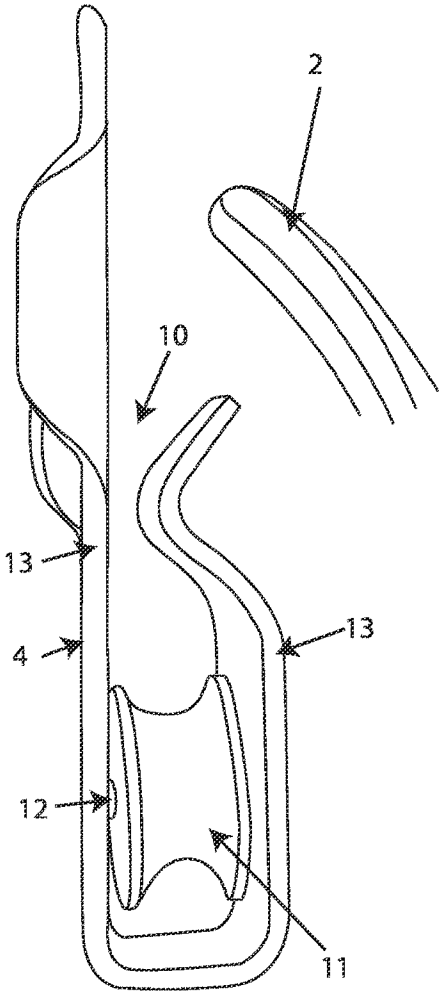
FIG. 4 shows a perspective view illustrating a Lanyard Pulley Attachment from a side, according to an embodiment of the presently claimed invention.

The various embodiments of the present invention will hereinafter be described in conjunction with the appended drawings.

DETAILED DESCRIPTION

As discussed above, embodiments of the present invention relate to a lanyard device and more particularly to a Lanyard Pulley Attachment.

Referring now to the drawings FIGS. 1-8, the Lanyard Pulley Attachment comprising a novel product offering consumers a practical solution to the aforementioned challenges. As the name implies, the Lanyard Pulley Attachment comprises a specially designed device that is structured and arranged to easily and quickly hoist a user up a rope. The Lanyard Pulley Attachment comprises a friction lock that grips your lanyard to ensure a user doesn't slip down the lanyard while using the attached pulley to climb back up. The open-ended design can attach quickly to your lanyard at any point, sliding up easily without needing to release the friction lock from the rope and allowing for one-handed operation. The Lanyard Pulley Attachment makes it simple for any climber to lift themselves to their original position after rappelling down, no matter where they are hanging from.

Easy to Use and Packed with Features and Benefits:

- Allows climbers to easily pull themselves up after rappelling down
- Works in conjunction with a lanyard assembly
- Pulley secured to friction lock with a rivet
- Saves time while providing effortless motion
- Easily attaches to an existing assembly
- One-handed use leaves one hand free for hand holds or tools The Lanyard Pulley Attachment is cost-effective to produce in the embodiments, as shown in FIGS. 1-8.

As shown in FIG. 1, the lanyard pulley attachment 1 is attached to a climbing rope or lanyard 2 by a user 3. The user 3 slips the rope 2 over the pulley 4 and, with the ascender 5, uses the lanyard pulley attachment 1 to climb back up to wherever the user 3 repelled down from.

Figure 3:
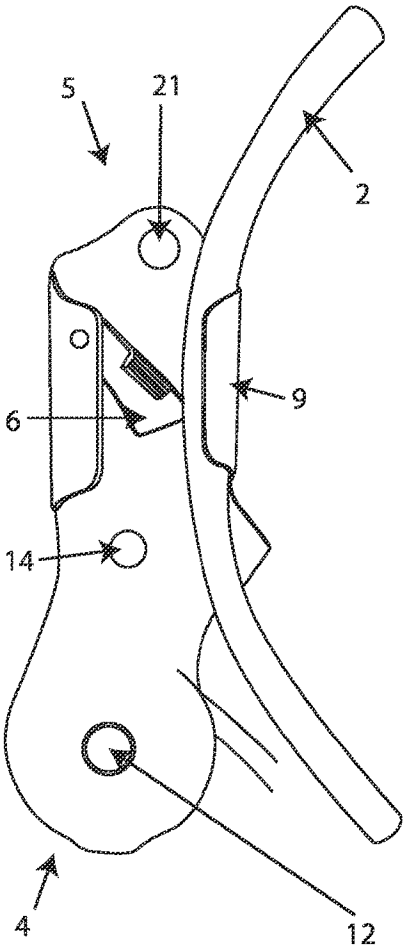
FIG. 3 shows a perspective view illustrating a Lanyard Pulley Attachment with a rope in place, according to an embodiment of the presently claimed invention.
Figure 2:
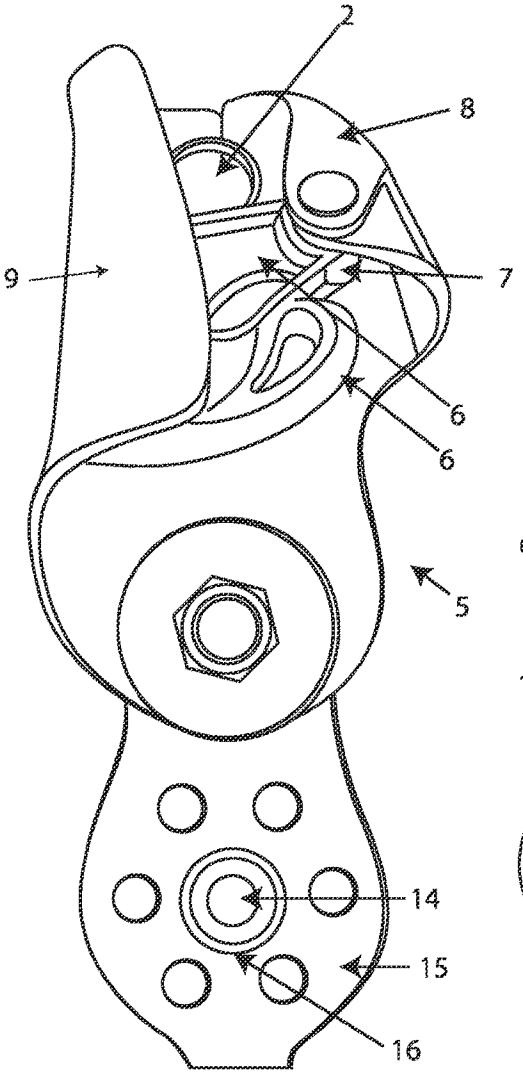
FIG. 2 shows a perspective view illustrating a Lanyard Pulley Attachment from the front base according to an embodiment of the presently claimed invention.
Figure 6:
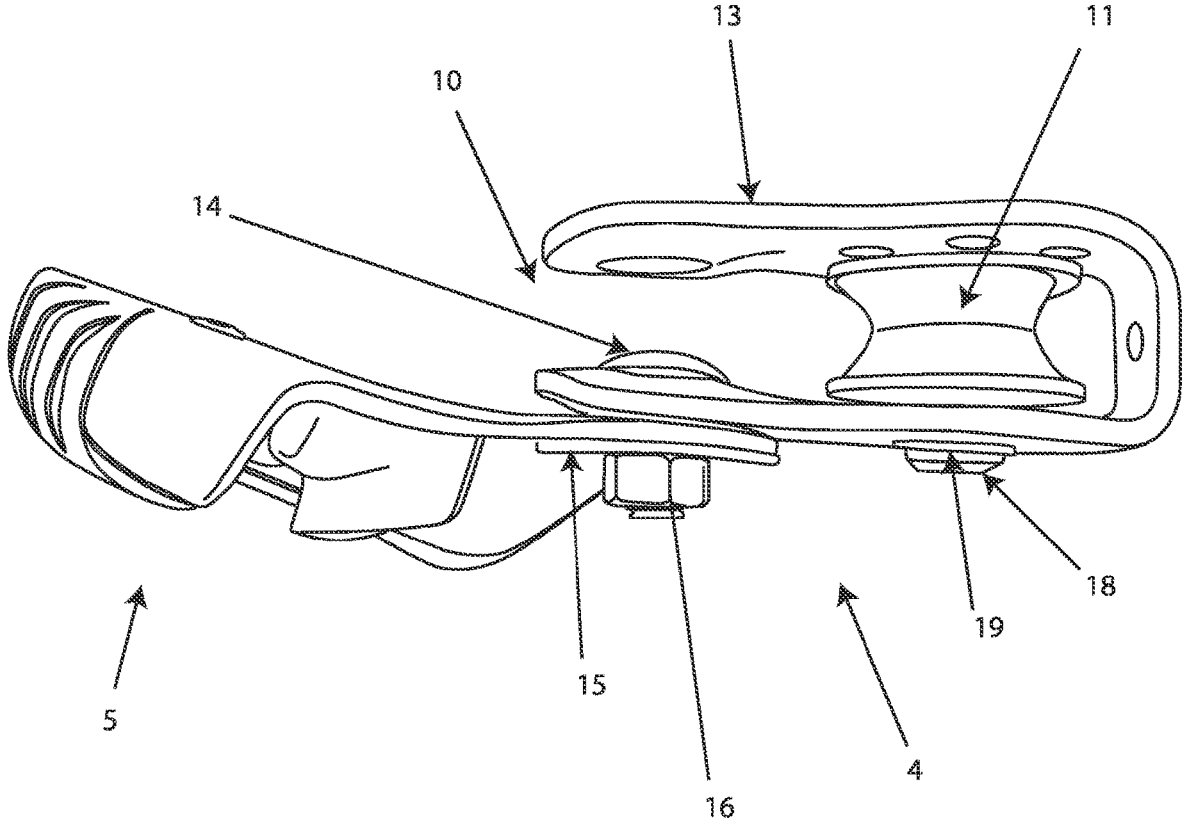
FIG. 6 shows a perspective view illustrating a Lanyard Pulley Attachment from a side, according to an embodiment of the presently claimed invention.
Figure 7:
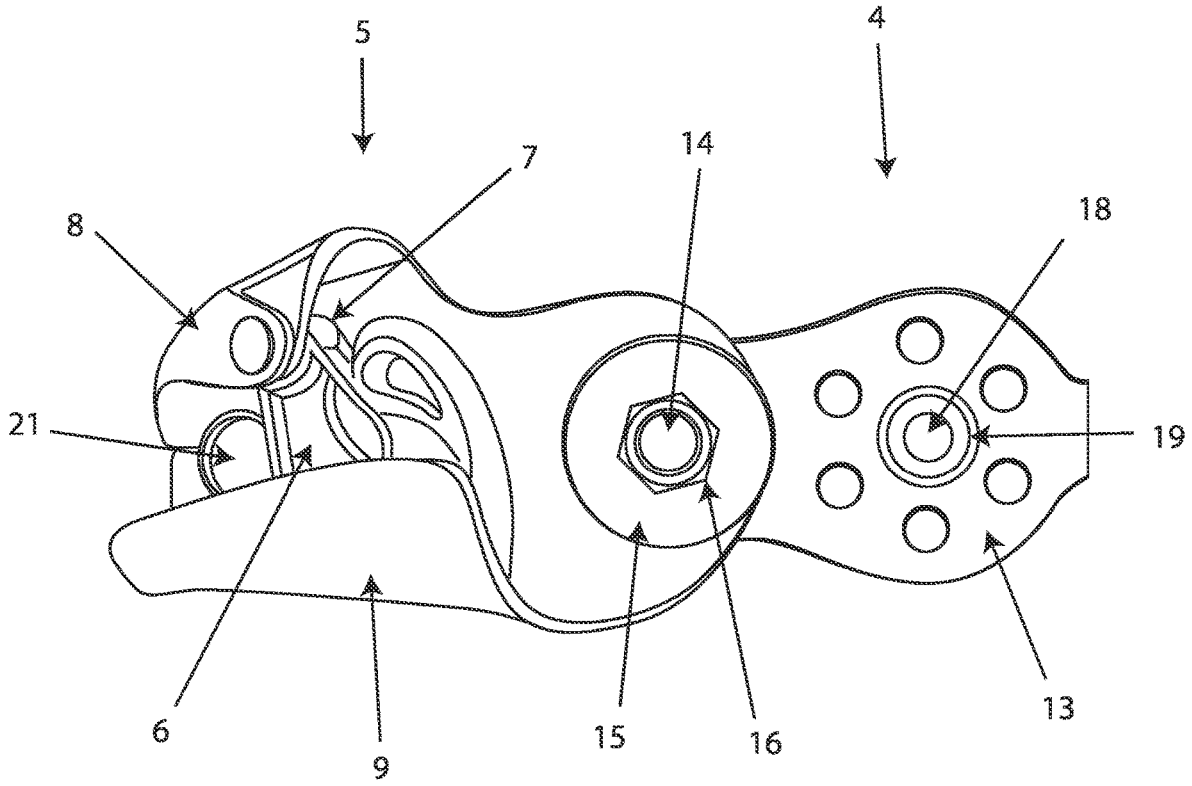
FIG. 7 shows a perspective view illustrating a Lanyard Pulley Attachment from the front, according to an embodiment of the presently claimed invention.
Figure 8:
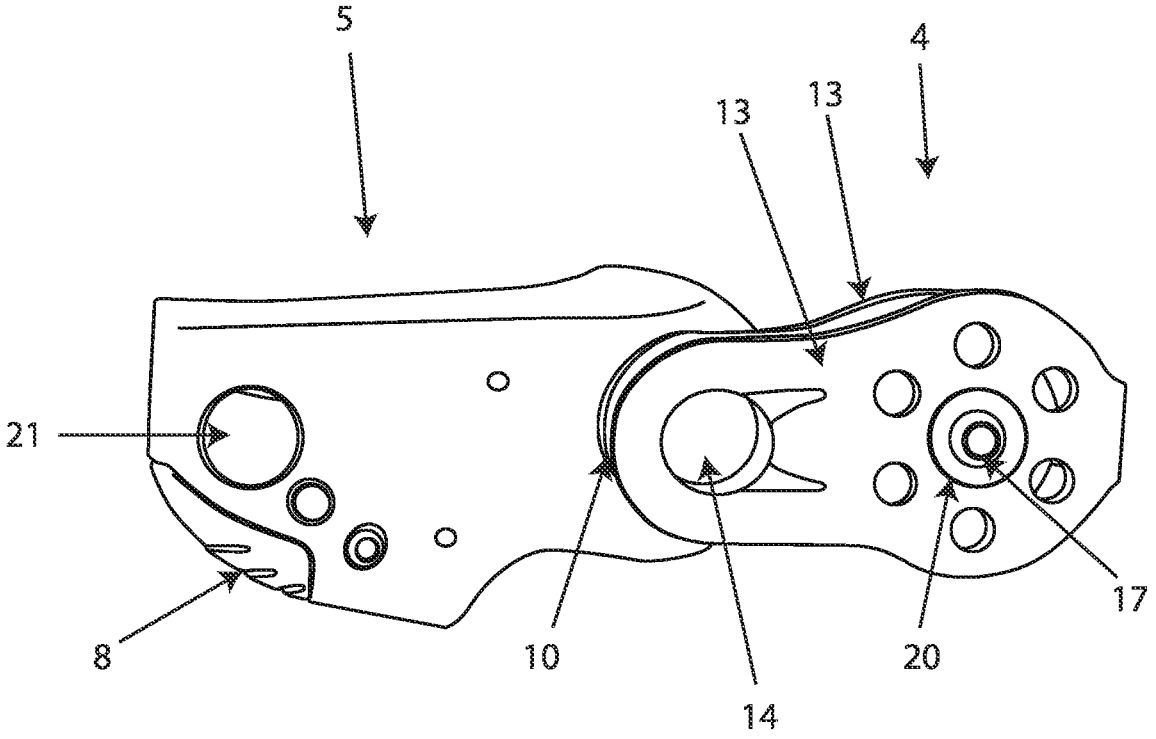
FIG. 8 shows a perspective view illustrating a Lanyard Pulley Attachment from the back, according to an embodiment of the presently claimed invention.

As shown in FIGS. 2-3, the ascender 5 has a friction lock 6 with a spring 7 incorporated to keep pressure against the rope 2, thereby allowing the rope to slide down through e ascender 5 but locking the rope 2 securely in place in the ascender 5 when the rope 2 tries to slide up. A thumb tab 8 allows the user 3 to release the friction lock 6 easily and ensures it is a one-handed operation to remove the ascender 5, attach the ascender 5, or to slide the ascender 5 up. The rope 2 slides along the ascender 5 in a rope groove 9.

As shown in FIGS. 3-8, an opening 10 at the top of the pulley 4 allows a user 3 to slot a looped rope 2 in one handed. The pulley 4 has a wheel 11 on an axel 12 bolted into the pulley case 13. The axel 12 can be a bolt, and is secured by a washer 19, 20 on the outside of a hole in both the front and back parts of the pulley case 13, and a nut 17 on the side of the bolt 12 opposite the bolt head 18.

As shown in FIGS. 2-8, the front of the pulley 4 is attached back of the ascender 5 by a bolt 14 that goes through a hole the front of the pulley case 13 and a hole in the ascender 5 and is removeably secured on the front of the ascender 5 by a washer 15 and nut 16 combination. A hole 21 in the top of the ascender 5 allows the lanyard pulley attachment 1 to be clipped to a carabineer or similar.

The various parts discussed above forming the pulley 4 and the ascender 5 are preferably made of one or more durable metals or alloys. The thumb tab 8 and parts of the friction lock 6 may be made of a durable plastic material.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claim:

1. An adjustable safety lanyard pulley lifeline device comprising:

(a) a pulley having
- (i) a pulley case;
- (ii) a wheel operationally arranged inside the pulley case;
- (iii) an axel; and
- (iv) an opening at a top part of the pulley case, wherein the opening is operationally arranged to allow a user to slot a looped rope onto the wheel with one hand;

(b) an ascender having
- (i) an ascender body;
- (ii) a rope groove arranged on one side of the ascender body, wherein a rope is securable in the rope groove when the ascender is in use;
- (iii) a friction lock with a spring, wherein the friction lock is operably arranged to keep pressure against the rope in the rope groove when the rope slides upward but release pressure on the rope when the rope slides downward;
- (iv) a thumb tab, wherein the thumb tab is operably connected to the friction lock to allow one-handed operation of the friction lock; and
- (v) a hole in a top of the ascender body, wherein the hole is operationally arranged to allow the adjustable safety lanyard pulley lifeline device to be clipped to the rope by a removeable security device, wherein a front of the pulley case is removeably secured to a back of the ascender body via a combination of a bolt, a washer, and a nut.

2. The adjustable safety lanyard pulley lifeline device according to claim 1, wherein the removeable security device is a carabineer.

3. The adjustable safety lanyard pulley lifeline device according to claim 1, wherein the pulley and the ascender body are formed of one or more durable metals or durable metal alloys.

4. The adjustable safety lanyard pulley lifeline device according to claim 1, wherein the thumb tab is formed of a plastic material.

5. The adjustable safety lanyard pulley lifeline device according to claim 1, wherein the axel of the pulley is a bolt, wherein the pulley further comprises an axel washer and an axel nut, and wherein the wheel is secured inside the pulley case by the axel, which is held in place by the axel washer and the axel nut.

6. An adjustable safety lanyard pulley lifeline device comprising:

(a) a pulley having
- (i) a pulley case;
- (ii) a wheel operationally arranged inside the pulley case;
- (iii) an axel bolt;
- (iv) an axel nut;
- (v) an axel washer, wherein the wheel is secured inside the pulley case by the axel bolt, which is held in place by the axel washer and the axel nut; and
- (vi) an opening at a top part of the pulley case, wherein the opening is operationally arranged to allow a user to slot a looped rope onto the wheel with one hand;

(b) an ascender having
- (i) an ascender body;
- (ii) a rope groove arranged on one side of the ascender body, wherein a rope is securable in the rope groove when the ascender is in use;
- (iii) a friction lock with a spring, wherein the friction lock is operably arranged to keep pressure against the rope in the rope groove when the rope slides upward but release pressure on the rope when the rope slides downward;

(iv) a thumb tab, wherein the thumb tab is operably connected to the friction lock to allow one-handed operation of the friction lock; and (v) a hole in a top of the ascender body, wherein the hole is operationally arranged to allow the adjustable safety lanyard pulley lifeline device to be clipped to the rope by a carabineer, wherein the pulley and the ascender body are formed of one or more durable metals or durable metal alloys, wherein the thumb tab is formed of a plastic material, wherein a front of the pulley case is removeably secured to a back of the ascender body via a combination of a bolt, a washer, and a nut.

* * * * *